United States Patent [19]

Wendt

[11] Patent Number: 4,565,041

[45] Date of Patent: Jan. 21, 1986

[54] MOVABLE PARTITION BASE ATTACHMENT

[75] Inventor: Alan C. Wendt, Barrington, Ill.

[73] Assignee: United States Gypsum Company, Chicago, Ill.

[21] Appl. No.: 492,894

[22] Filed: May 9, 1983

[51] Int. Cl.[4] ..... E04B 1/00

[52] U.S. Cl. ..... 52/288; 52/290; 52/718.1

[58] Field of Search ..... 52/287, 288, 273, 278, 52/290, 396, 242, 466, 469, 511, 512, 717, 718, 403, 506, 508, 630, 730; 248/216.1, 217.3, 220.2; 174/48; 138/115

[56] References Cited

U.S. PATENT DOCUMENTS

| | | | |
|---|---|---|---|
| 1,572,377 | 2/1926 | Blair | 52/630 |
| 2,114,770 | 4/1938 | Shipway et al. | 52/242 |
| 2,221,854 | 11/1940 | Zalkind | 52/730 |
| 2,703,002 | 3/1955 | Suskind | 52/242 |
| 2,887,870 | 5/1959 | Slowinski | 52/242 |
| 3,228,160 | 1/1966 | O'Brien | 52/242 |
| 3,255,561 | 6/1966 | Cable | 52/288 |
| 3,321,878 | 5/1967 | Brown et al. | 52/288 |
| 3,786,171 | 1/1974 | Shira | 138/115 |
| 3,908,328 | 9/1975 | Nelson | 52/242 |
| 4,004,381 | 1/1977 | Pichler et al. | 52/288 |
| 4,133,153 | 1/1979 | Hage | 52/242 |
| 4,204,376 | 5/1980 | Calvert | 52/287 |
| 4,294,422 | 10/1981 | Odekirk | 248/216.1 |
| 4,394,808 | 7/1983 | Thorsell | 52/511 |

FOREIGN PATENT DOCUMENTS

| | | | |
|---|---|---|---|
| 231382 | 8/1959 | Australia | 52/718 |
| 699318 | 12/1964 | Canada | 52/278 |
| 1063619 | 5/1954 | France | 52/278 |
| 1305181 | 8/1962 | France | 174/48 |
| 6800553 | 7/1969 | Netherlands | 52/290 |
| 156271 | 9/1956 | Sweden | 52/287 |
| 189142 | 4/1964 | Sweden | 52/718 |
| 206242 | 11/1923 | United Kingdom | 248/217.3 |
| 584643 | 1/1947 | United Kingdom | 52/290 |
| 1144551 | 3/1969 | United Kingdom | 52/287 |

*Primary Examiner*—John E. Murtagh
*Assistant Examiner*—Andrew Joseph Rudy
*Attorney, Agent, or Firm*—Samuel Kurlandsky; Robert M. Didrick; Robert H. Robinson

[57] ABSTRACT

A base trim attachment assembly is provided for movable partitions comprising retainer clips having formed barbs which are installed into gypsum panels by pressing the barbs into the panels, and having means for receiving a nail which is driven on a downward angle into the panels. The nails prevent outward movement of the clips and the barbs restrict any upward movement which would normally permit loosening of the nails. After the clips are installed, the base is slipped down over the clips until it snaps in place. The present structure permits a very thin base which matches existing moveable partition components.

8 Claims, 7 Drawing Figures

MOVABLE PARTITION BASE ATTACHMENT

BACKGROUND OF THE INVENTION

1. Field of the Invention

The present invention relates to movable partitions installations, and more particularly concerns a novel structure comprising a combination of a base trim and complementary retainer clips.

2. Description of the Prior Art

Conventional demountable partition systems utilize a clip-on base system wherein the clips are screw-attached to the partition. The clips are normally screw-attached to a deep legged floor runner or to the supporting studs. The systems require a base with a cavity that is sufficient to accept a gauge clip and the head of a screw. Many of these systems do not match the decor of other components and are often aesthetically unacceptable.

SUMMARY OF THE INVENTION

Accordingly it is an object of the present invention to provide a base trim for movable partitions and a complementary retainer clip which system is simple to apply to a wall of a movable partition. It is a further object to provide a combination of the type described which permits firm attachment of the trim to the wall.

It is an additional object to provide a combination base trim and retainer clip which is relatively simple and inexpensive to manufacture. Still further objects and advantages of the invention will appear from the description which follows and from the drawings.

To the accomplishment of the foregoing and related ends, the invention comprises a combination of a base trim and retainer clip for use in application to gypsum panels particularly of movable partitions. The clip comprises a portion for being inserted into an integral channel provided in the base trim. The clip additionally has a formed barb which is pressed into the gypsum panel to prevent lateral and up and down movement of the clip. An elongated aperture is also provided so that a nail may be inserted therethrough at an acute angle with respect to the wall and driven into the wall. The nail and barb cooperate to prevent movement of the clip.

DESCRIPTION OF THE PREFERRED EMBODIMENTS

Figure 1:
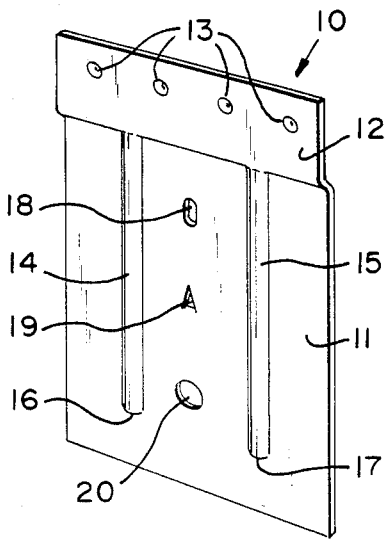
FIG. 1 is a perspective view of an attachment clip according to the invention.

Referring to FIGS. 1–4, a base attachment clip 10 according to the invention is shown comprising a flat body member 11, an offset panel or margin 12 substantially parallel to the body portion 11 and having a plurality of dimples 13, and longitudinal stiffening ribs 14 and 15 provided in body portion 11. The rib ends 16 and 17 are substantially flat and perpendicular to the body 11, and serve as detents. Provided in the flat body portion 11 intermediate the stiffening ribs 14 and 15 are an elongate aperture 18 adapted to receive an attaching nail inserted at an angle, a barb 19 struck from the body portion 11 for preventing longitudinal and lateral movement of the base attachment clip 10, and a larger round aperture 20 for insertion of a screw, when desired.

Figure 2:
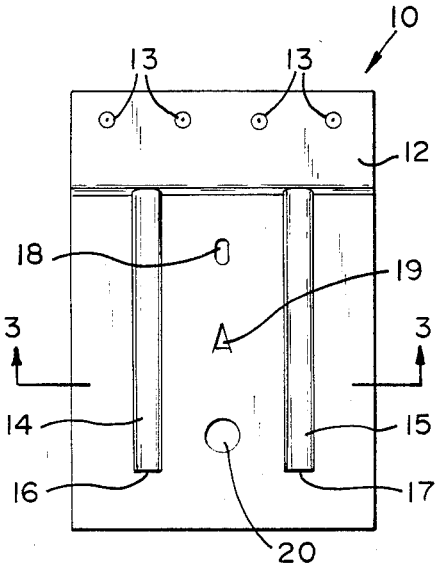
FIG. 2 is a front elevational view of the structure shown in FIG. 1.
Figure 4:
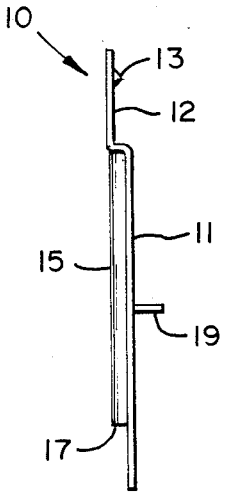
FIG. 4 is an end elevational view of the attachment clip.
Figure 3:
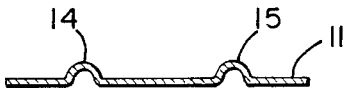
FIG. 3 is a cross-sectional view taken at the line 3—3 of FIG. 2, looking in the direction of the arrows.
Figure 5:
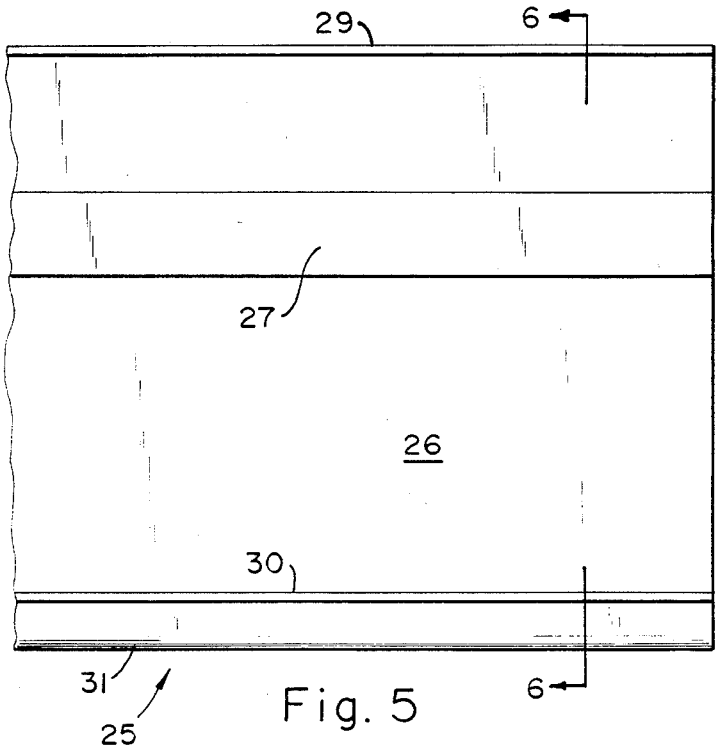
FIG. 5 is a rear elevational view of a base trim unit according to the invention.
Figure 6:
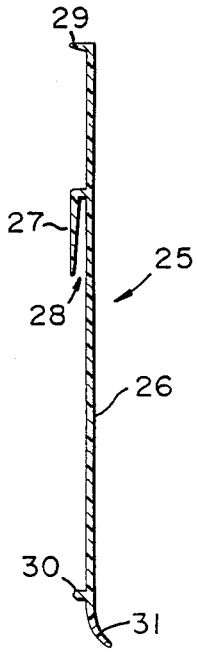
FIG. 6 is a cross-sectional view taken at the line 6—6 of FIG. 5, looking in the direction of the arrows.

Referring to FIGS. 5 and 6, the base trim 25 is shown comprising a body panel 26 provided with a flange 27 spaced from the body panel 26 to define a recess or pocket 28. An upper rib 29 and lower rib 30 are provided for engaging the wall on which the structure is mounted. The rib 30 also serves to engage the rib ends 16 and 17 of the clip 10 which rib ends are cut to provide engagement with the ribs 30, as shown in FIGS. 1, 2, and 4. A lower edge 31 is shown which is integral with the body panel 26 but formed by co-extrusion of a softer and flexible material.

Figure 7:
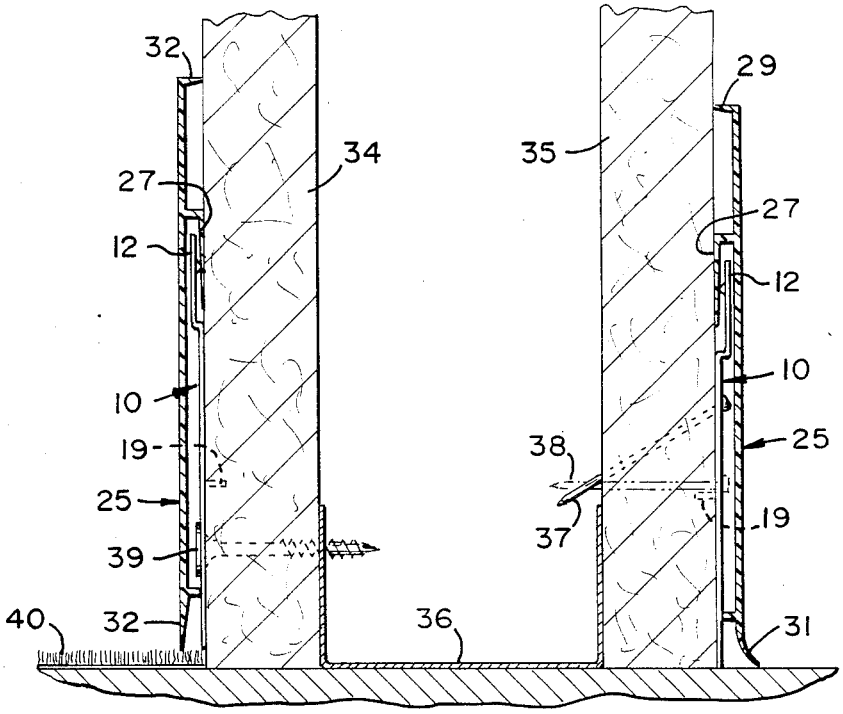
FIG. 7 is an edge elevational view, partly in cross-section, of a wall structure having a pair of the base trim attachment assemblies mounted thereon.

Referring to FIG. 7, an assembled wall structure is shown comprising gypsum wallboard 34 and 35 separated by a floor runner 36. Base attachment clips 10 are shown mounted one on each wallboard. Mounted over the base attachment clips 10 are base trims 25. In the structure mounted on the right wallboard 35 the base attachment clip 10 is mounted on the wallboard by driving in the barb 19. A finishing nail 37 is then driven in at an acute angle with respect to the wall surface. Optionally, as shown a second nail 38 is driven through the hole formed by striking out the barb 19 and may be driven at an angle perpendicular to the wallboard surface. Alternatively as shown in respect to the wallboard 34, a screw 39 may be inserted through the round aperture 20 and into the gypsum wall, and passing through a flange of the floor runner 36.

The base structure is applied to the wallboard by first mounting the base attachment clip 10, driving the barb 19 into the wall. A finishing nail 37 is placed into the elongate aperture 18 and driven into the wall at an acute angle. If desired a second nail may be driven through the aperture provided by the barb 19, or a screw 39 may then be driven through the large round aperture 20. The base trim is then mounted by placing the flange 27 between the offset panel 12 and the wall surface. The structure is slid down until the lower edge engages the floor. The base trim is maintained in place by pressure provided by the dimples 13 and engagement of base rib 30 with clip rib ends 16 and 17. Where the structure is mounted over a hard floor, the lower flexible edge 31 contours itself to provide engagement with the floor. As shown with regard to the wallboard panel 34, when the base trim is applied over a soft carpet 40, a rigid lower edge 32 may be utilized.

The present base trim attachment assembly has several advantages over prior art structures. The base attachment clip may be readily fabricated from sheet steel or galvanized sheet steel by a stamping operation. The base trim may be extruded from plastic material such as polyvinyl chloride or any other suitable plastic material. The lower edge of the trim may be made flexible by co-extrusion with a flexible polymer. Alternatively a harder lower edge may be provided by simple extrusion of a single more rigid material.

The assembly may be readily applied to a wall. The assembly is relatively simple and inexpensive to manufacture.

It is to be understood that the invention is not to be limited to the exact details of construction or operation or materials shown and described, as obvious modifications and equivalents to one skilled in the art.

Invention is claimed as follows:

1. A base trim and attachment assembly for mounting at a lower base of a wall panel, comprising, a base attachment clip formed of sheet metal having a body portion, an offset margin substantially parallel to said body portion, an integral barb extending laterally from said body portion and adapted to penetrate the surface of said wall panel, and an elongate aperture of uniform width throughout provided in the body portion of said base attachment clip to receive a nail to be engaged in said wall panel at an acute angle, the body portion of said attachment being provided with longitudinal stiffening ribs each having an upper end and a lower end, the lower end of said longitudinal stiffening ribs being cut to provide detents, and a base trim member having a body portion and a flange offset from said body portion defining a pocket received in the offset margin of said base attachment clip for retaining said base trim in mounted position on said wall panel, said base trim being provided with a lower rib engaging the cut ends of said longitudinal stiffening ribs and to be detained thereby, said base trim being readily demountable from said base attachment clip.

2. A base trim and attachment assembly according to claim 1, wherein said offset margin is provided with a plurality of dimples for friction engagement with the offset flange of said base trim member.

3. A base trim and attachment assembly according to claim 1, wherein the body portion of said attachment clip is provided with a round aperture adapted to receive a screw to be engaged in said wall panel.

4. A base trim and attachment assembly according to claim 1, wherein said base trim is formed of polyvinyl chloride.

5. In combination, a structural wall panel affixed to a wall support, and a base trim and attachment assembly mounted at a lower margin of said wall panel, said assembly comprising:

a base attachment clip formed of sheet metal having a body portion, an offset margin substantially parallel to said body portion, an integral barb extending laterally from said body portion and penetrating the surface of said wall panel, and an elongate aperture of uniform width throughout provided in the body portion of said base attachment clip having a nail extending through said elongate aperature at an acute angle affixing said base attachment clip to said wall panel, the body portion of said attachment clip being provided with longitudinal stiffening ribs each having an upper end and a lower end, the lower ends of said longitudinal stiffening ribs being cut to provide detents, and a base trim member having a body portion and a flange offset from said body portion defining a pocket receiving the offset margin of said base attachment clip, thereby retaining said base trim member in mounted position on said wall panel, the body portion of said base trim member being provided with a lower rib engaging and being detained by the lower cut ends of said longitudinal stiffening ribs, said base trim being readily demountable from said base attachment clip.

6. A combination according to claim 5, wherein said offset margin is provided with a plurality of dimples for friction engagement with the offset flange of said base trim member.

7. A combination according to claim 5, wherein the body portion of said attachment clip is provided with a round aperture receiving a screw engaged in said wall panel.

8. A combination according to claim 5, wherein said base trim is formed of polyvinyl chloride.

* * * * *